United States Patent [19]

Volpe

[11] 4,137,876

[45] Feb. 6, 1979

[54] OPENING DEVICE FOR THE BUTTERFLY VALVE OF A CARBURETOR

[75] Inventor: Mario Volpe, Bovray-sur-Juine, France

[73] Assignee: Regie Nationale des Usines Renault, Boulogne-Billancourt, France

[21] Appl. No.: 786,869

[22] Filed: Apr. 12, 1977

[30] Foreign Application Priority Data

Apr. 12, 1976 [FR] France ..... 76 10720

[51] Int. Cl.[2] ..... F02D 11/08

[52] U.S. Cl. ..... 123/103 R; 123/103 C; 261/DIG. 19

[58] Field of Search ..... 123/97 B, 103 R, 103 B, 123/103 C, 103 E; 261/DIG. 19, 65

[56] References Cited

U.S. PATENT DOCUMENTS

| | | | |
|---|---|---|---|
| 2,315,912 | 4/1943 | Udale | 261/65 |
| 2,588,136 | 3/1952 | Mallory | 123/103 R |
| 3,623,465 | 11/1971 | Wawrziniok | 123/103 C |
| 4,015,568 | 4/1977 | Horiye et al. | 123/97 B |

FOREIGN PATENT DOCUMENTS

| | | | |
|---|---|---|---|
| 2315617 | 6/1975 | France | 123/103 R |

*Primary Examiner*—Charles J. Myhre
*Assistant Examiner*—Craig R. Feinberg
*Attorney, Agent, or Firm*—Oblon, Fisher, Spivak, McClelland & Maier

[57] ABSTRACT

An anti-pollution system for internal combustion engines, in particular for avoiding the emission of unburned fuel during changes of motor speed in deceleration. A pneumatic capsule acts to open the throttle under the action of the vacuum in the induction pipe by the intermediary of a spring-loaded valve set to open at a given level of vacuum. The capsule has a diaphragm which tends to close the throttle of the carburetor under the action of an elastic member over its entire return travel and under the additional action of a second elastic means of return, called a compensator spring, over a part of the return travel, from the position of maximum opening of the throttle under the action of the diaphragm, when the compensator spring is compressed against an adjustable stop under the action of the vacuum.

4 Claims, 2 Drawing Figures

OPENING DEVICE FOR THE BUTTERFLY VALVE OF A CARBURETOR

BACKGROUND OF THE INVENTION

1. Field of the Invention

The present invention relates to a device for maintaining a partial opening of the throttle during deceleration for carburetors of clean-burning internal combustion engines.

2. Description of the Prior Art

Known carburetors generally have a device called a "throttle opener" which, when one ceases accelerating in starting up a vehicle, thus reclosing the throttle, again partially opens this throttle in order to avoid too great a vacuum in the induction pipe which would result in draining the idling passage and drying up the fuel supply for filling it. The consequence of this situation is to allow the escape of unburned hydrocarbons and produce too lean a mixture in the motor, as well as hesitations in reaccelerating, part of the fuel being taken up in repriming the circuits and refilling the passages previously drained.

These throttle-partial opening devices generally consist of a capsule with a diaphragm connected to the induction pipe downstream of the carburetor throttle. The vacuum in the pipe acts on the diaphragm, which in turn opens the throttle, thus correcting the vacuum, on the one hand, and permitting, on the other, the admission to the motor of a mixture sufficiently rich for combustion and not producing unburned hydrocarbons in the exhaust.

These devices, however, lack sensitivity and do not give complete satisfaction. In particular, at the moment of lifting the foot from the accelerator, they do not prevent complete closure of the throttle, causing the vacuum necessary to reopen it and thus the production of unburned hydrocarbons during this period. Likewise, at the end of a period of deceleration, the corresponding decrease in vacuum in the pipe causes the premature closure of the throttle to the idling position and production of unburned hydrocarbons.

SUMMARY OF THE INVENTION

The object of the present invention is to provide a throttle-partial opening device in deceleration which permits remedying these drawbacks by an instantaneous response at the moment of lifting the foot, without returning to premature idle at the beginning and end of deceleration, avoiding the puffs of unburned hydrocarbons consequent to this return to idle.

For this purpose, the present invention comprises a vacuum pneumatic capsule controlling the partial opening of the throttle in deceleration characterized by the fact that the means of returning the diaphragm, causing the closure of the throttle against the force of the vacuum, consists of two springs, one with a low return force acting over the entire course of travel for opening the throttle, the other with greater force adding to the force of the first over a reduced travel distance at the position of maximum opening.

In addition, the effect and the duration of the vacuum acting in the diaphragm are modulated by a spring-loaded valve, of self-evident type, subjecting the capsule diaphragm to the effect of the vacuum only above a certain level of vacuum in the pipe, as well as by a delayed pressure recovery valve, also of self-evident type for other applications, which delays the return to closure of the capsule and the throttle when the spring-loaded valve is closed under the action of too low a vacuum.

This device consequently gives better adjustment of throttle opening relative to motor speed. As soon as the threshold of vacuum is attained in the induction pipe, e.g., upon lifting the foot from the accelerator, the spring-loaded valve opens and activates the capsule diaphragm to open the throttle. Initially, the high vacuum created by the closing of the throttle, upon lifting the foot, will compress the two return springs of the capsule, opening the throttle to a relatively high idle speed (e.g., of the order of 1900 RPM).

In the course of deceleration, the decrease in vacuum will lead first, under the cumulative action of the two return springs of the diaphragm, toward a rapid closure of the throttle, then to a more gradual closing action, under the action of the single weaker return spring, maintaining a degree of opening sufficient to allow good combustion of the hydrocarbons of the fuel mixture, while still maintaining sufficient deceleration to satisfy the driver, i.e., a significant slowing of the vehicle upon lifting the foot from the accelerator.

At a predetermined value of vacuum, the spring-loaded valve recloses and the vacuum ceases to act on the capsule diaphragm governing the throttle, as well as on the delayed pressure recovery valve, which then allows outside air to filter into the capsule, causing gradual closure of the throttle to the idle position, e.g., after a period of the order of 5 seconds or well after the moment of shifting in the case of changing gears. The puff of hydrocarbons marking the attainment of idling speed does not then have time to occur.

Thus, in accordance with the invention, the throttle-partial opening device for the carburetor in deceleration for internal combustion engines has a pneumatic capsule which opens the throttle under the action of the vacuum in the induction pipe by the intermediary of a spring-loaded valve set to open at a given level of vacuum, characterized by the fact that the capsule has a diaphragm which recloses the carburetor throttle under the action of an elastic means over the entire return travel and under the additional action of a second elastic means, called a compensator spring, over a portion of the return travel, from the position of maximum throttle opening under the action of the said diaphragm, when the compensator spring is compressed against an adjustable stop under the action of the vacuum.

The compensator spring may be mounted on the diaphragm and move with it and a delayed pressure recovery valve is connected to the line between the capsule and the spring-loaded valve.

The air intake for the delayed pressure recovery valve may be a line opening into the carburetor upstream of the throttle. More precisely, the air intake for the delayed pressure recovery valve may consist of a line opening into the carburetor immediately downstream of its venturi.

Thus, starting with a high-speed opening giving good initial combustion, there is a rapid decrease to a lower speed, approaching or even attaining idling speed, without producing polluting puffs of hydrocarbons, thanks to the combined operation of the means of the invention.

BRIEF DESCRIPTION OF THE DRAWINGS

Various other objects, features and attendant advantages of the present invention will be more fully appreciated as the same becomes better understood from the following detailed description, when considered in connection with the accompanying drawings wherein like reference numerals designate like or corresponding parts throughout the several views, and in which.

DETAILED DESCRIPTION OF A PREFERRED EMBODIMENT

Figure 1:
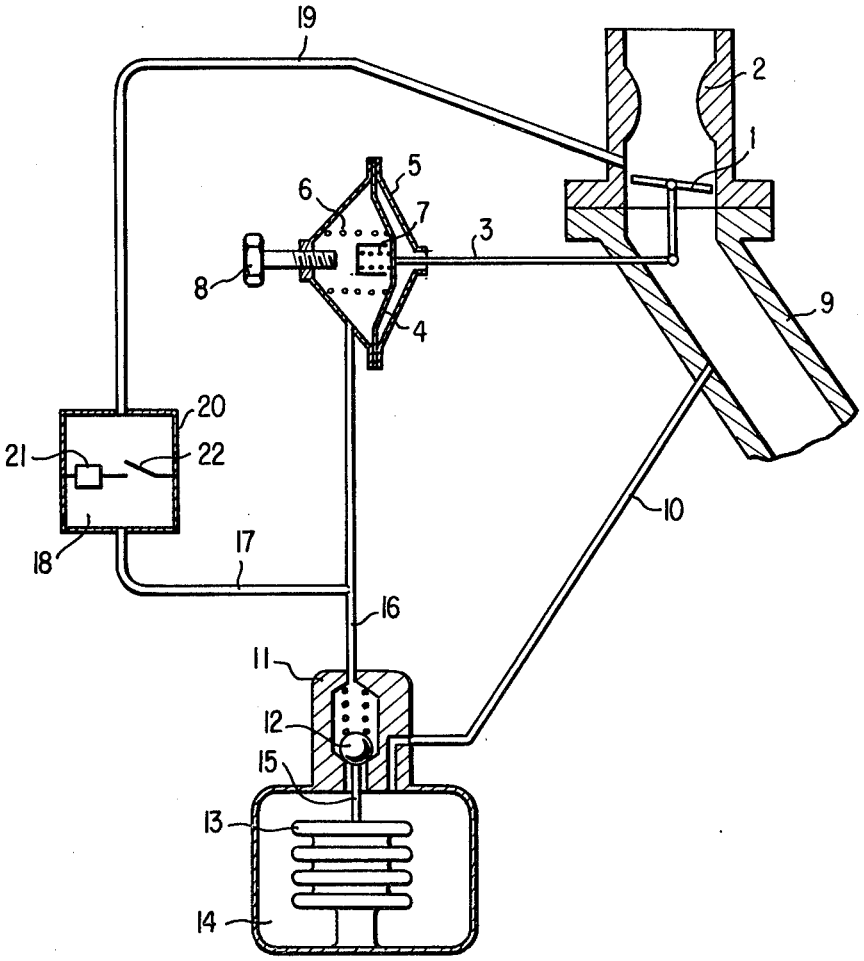
FIG. 1 represents schematically the complete deceleration device of this invention.

Referring now to the drawings, and more particularly to FIG. 1, the throttle 1 of a carburetor 2 is controlled with respect to its degree of partial opening by a rod 3 connected to a diaphragm 4 of a throttle-partial opening capsule 5. This diaphragm 4 recloses the throttle, over its entire travel, under the action of a spring 6 and, over a portion of its travel, by a supplementary compensator spring 7 when the latter is compressed against an adjustable stop 8 under the action of the vacuum in the induction pipe 9 transmitted through a line 10 connected to a spring-loaded valve 11. This valve, of known type, is normally closed by a ball 12, and opens under the action of a given vacuum, which causes the expansion of a bellows 13 situated in an airtight housing 14 and the unseating of the ball 12 by a push-rod 15 associated with the bellows 13, thus putting the vacuum of line 10 in communication with a line 16 connected to the capsule 5 and a line 17 connected to the delayed pressure recovery valve 18, itself communicating through a line 19 with the carburetor passage between the throttle 1 and the venturi of the carburetor 2 immediately downstream of the venturi.

This delayed pressure recovery valve 18, also of known type, like the spring-loaded valve 11, is composed of a valve 20 connected to tubes 17 and 19 and closed by a central transverse partition provided on the one hand with an orifice closed by a porous plug 21, allowing a certain proportion of air to leak through in either direction and, on the other hand, with a second orifice closed by a flexible flap 22, opening wide to air passing from tube 17 to tube 19, and closing against flow in the opposite direction.

This arrangement guarantees at high speeds, when valve 11 is closed, a certain vacuum in the capsule 5 due to the aspiration effect produced by the high-speed flow of air at the venturi outlet in carburetor 2. This steady vacuum at high speeds causes, when the foot is lifted at the beginning of deceleration, the instantaneous return of the throttle to its closed position, against the action of the spring 6 of low compression force, until the stronger compensator spring contacts the adjustable stop 8. Thus, the combination of the capsule 5 and its pair of return springs 6 and 7 with the delayed pressure recovery valve 20 permits a more rapid response of the motor in decelerating, which increases driving satisfaction, while avoiding complete closure of the throttle to idling position, which likewise prevents a puff of unburned hydrocarbons in the initial stage of deceleration.

Suitable adjustment of the stop 8, which is threaded into the capsule 5, and the forces of the springs 6 and 7, as a function of the vacuum prevailing in the capsule 5 at high speeds, permits operation of the system along the following lines:

(a) Upon lifting the foot, the force holding the throttle 1 open disappears, and the vacuum in the capsule 5 produced by the aspiration effect in the tube 19 across the valve 20, the flap 22 being closed, instantaneously returns the throttle 1 to its closed position against the weak spring 6 alone.

(b) The reaction of the stiffer spring 7 against the stop 8 stops and repels the open throttle 1, momentarily in high-speed position, on the order of 1900 to 2000 RPM, thus avoiding the initial puff of unburned hydrocarbons which a complete closure of the throttle would produce.

(c) The vacuum formed in the tube 9 by this momentary partial closure of the throttle causes the valve 11 to open and activate the capsule 5 to open the throttle with compression of the springs 6 and 7. Simultaneously, the flexible flap 22 of the valve 20 closes.

(d) The vacuum decreasing with deceleration causes relatively rapid closure of the throttle 1 under the action of the compensator spring 7, followed by a pause at an intermediate position and then a more gradual closure of the throttle 1 under the action of the spring 6 above.

(e) When the vacuum in the tube 9 diminishes to the level of closure of valve 11, the vacuum in the capsule 5 continues to decrease more slowly under the action of the only air leak, through the porous plug 21 of the delayed pressure recovery valve 20, permitting shifting before reaching the idling position of the throttle 1 and thus avoiding the puff of unburned hydrocarbons at the end of deceleration.

Spring loaded valve 11 is closed in operation due to ball 12 when pressures in lines 19 and 10 are nearly equal, butterfly throttle 1 being open by mechanical action. Pressures in lines 19 and 17 are also equalized through the opening of flexible flap 22 when the sudden release of the gas pedal closes throttle 1. As the throttle valve closes, a constriction is formed adjacent line 19 causing a high vacuum in line 19 due to aspiration opening throttle 1 through flexible flap 22, line 17 and action of capsule 5 bouncing on supplemental compensator spring 7 so as to close throttle 1, again partially creating vacuum in induction pipe 9 and opening ball 12 through expansion of bellows 13. Vacuum in line 17 closes flexible flap 22 and actuates capsule 5 opening throttle 1 once more and closing the same quickly under receding vacuum and quick action of spring 7 followed by slower action of weaker spring 6, decreasing vacuum in induction pipe 9 so as to finally close ball 12 again. Pressures will slowly equalize between lines 16, 17 and 19 through porous plug 21 while the engine is clutched before idling. Therefore, as a result of this deceleration condition, pressures upstream and downstream of valve 20 are equalized.

Figure 2:
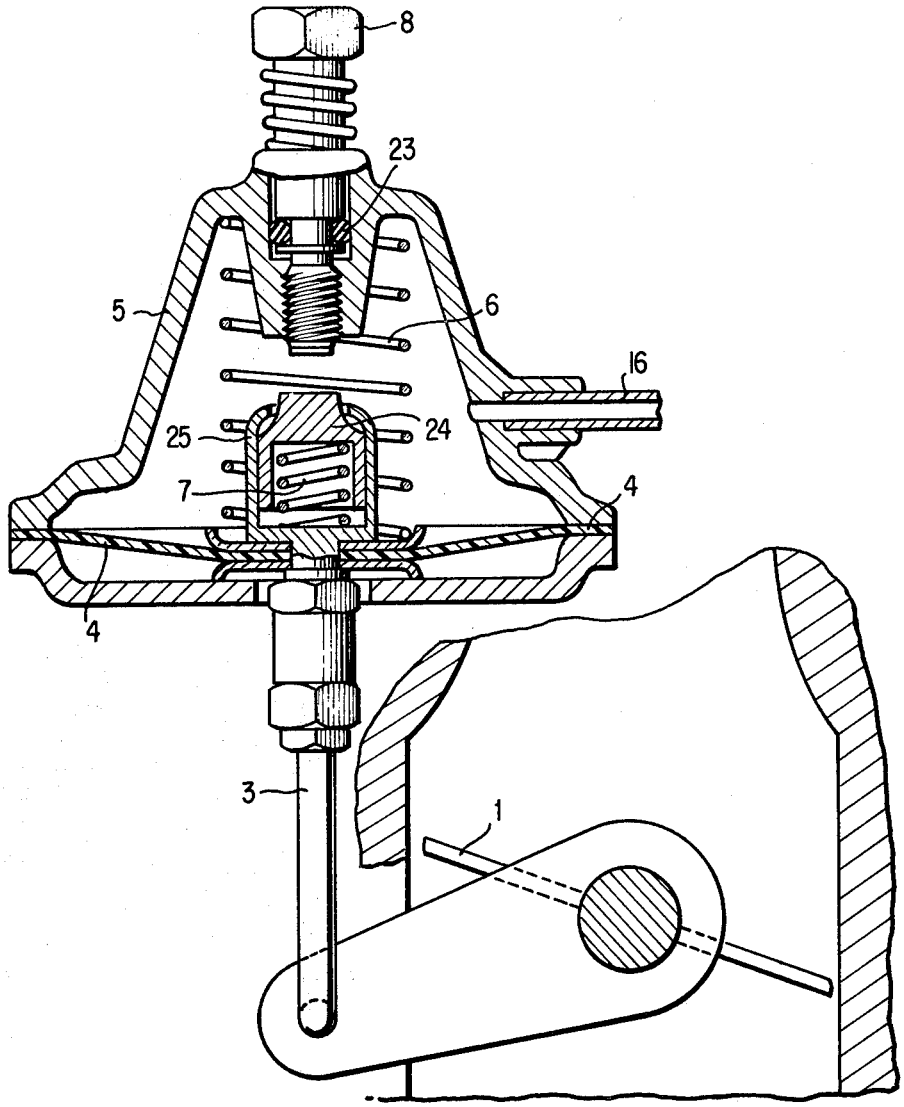
FIG. 2 shows a larger-scale cross-section of a capsule for controlling the throttle shown in FIG. 1.

FIG. 2 shows an embodiment, on a larger scale, of the vacuum capsule 5 acting on the throttle 1 through the rod 3 operatively associated with conventional linkage member 3*a* for pneumatic control. The adjustable stop 8 has a seal 23. The compensator spring 7 is mounted in a cup 24 forming the stop contactor, the cup itself sliding within another cup 25 attached to the diaphragm 4.

Obviously many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A throttle-partial opening device for a carburetor of an internal combustion engine for opening the throttle during deceleration, being provided with a pneumatic capsule operating to open the throttle under the action of the vacuum in an induction pipe through the intermediary of a spring-loaded valve set to open at a given level of vacuum, the improvement comprising:

a diaphragm in said capsule and being operatively connected to said carburetor throttle;

an adjustable stop member connected to said pneumatic capsule;

first elastic means in said capsule urging said diaphragm in a direction to close said carburetor throttle over its entire return travel;

second elastic means in said capsule urging said diaphragm in said direction to close said carburetor throttle over only a part of said return travel, from the position of maximum throttle opening, said second elastic means then being compressed against said adjustable stop member in said capsule under the influence of the vacuum;

conduit means connecting said capsule with said induction pipe downstream of said throttle and having therein a spring-loaded valve for permitting said vacuum therein to act upon said diaphragm for opening said throttle at said given level of vacuum; and a delayed pressure recovery valve connected to said conduit means between said capsule and said spring-loaded valve.

2. A device as set forth in claim 1, wherein said spring-loaded valve includes a spring member, a ball engaged with said spring, a push rod and an associated bellows expandable in response to communication with said vacuum.

3. A device as set forth in claim 1, further comprising an air intake for the delayed pressure recovery valve opening into the carburetor upstream of the throttle.

4. A device as set forth in claim 3, wherein said air intake for the delayed pressure recovery valve is a line opening into the carburetor immediately downstream of a venturi of the carburetor.

* * * * *

UNITED STATES PATENT AND TRADEMARK OFFICE

CERTIFICATE OF CORRECTION

PATENT NO. : 4,137,876

DATED : FEBRUARY 6, 1979

INVENTOR(S) : MARIO VOLPE

It is certified that error appears in the above—identified patent and that said Letters Patent is hereby corrected as shown below:

In Column 3, line 51, change "closed" to --open --;

In Column 4, delete lines 2-9 and substitute the following language "returns the throttle 1 to its open position, first against the weak spring 6, and thereafter against the stiffer spring 7 momentarily in high-speed position, on the order of 1900 to 2000 RPM, thus avoiding the initial puff of unburned hydrocarbons which a complete closure of the throttle would produce.

(b) the reaction of the stiffer spring 7 against the stop 8 stops and repels the throttle 1 to its closed position."

Signed and Sealed this

*Third* Day of *November 1981*

[SEAL]

*Attest:*

GERALD J. MOSSINGHOFF

*Attesting Officer* *Commissioner of Patents and Trademarks*